US011383127B1

(12) United States Patent
Houchin-Miller

(10) Patent No.: US 11,383,127 B1
(45) Date of Patent: Jul. 12, 2022

(54) MECHANISM TO PROVIDE INTUITIVE MOTION FOR BICYCLE TRAINERS

(71) Applicant: Gary Phillip Houchin-Miller, Fox Point, WI (US)

(72) Inventor: Gary Phillip Houchin-Miller, Fox Point, WI (US)

( * ) Notice: Subject to any disclaimer, the term of this patent is extended or adjusted under 35 U.S.C. 154(b) by 173 days.

(21) Appl. No.: 16/787,013

(22) Filed: Feb. 11, 2020

Related U.S. Application Data

(60) Provisional application No. 62/832,909, filed on Apr. 12, 2019, provisional application No. 62/804,094, filed on Feb. 11, 2019.

(51) Int. Cl.

| | |
|---|---|
| ***A63B 22/06*** | (2006.01) |
| ***A63B 69/16*** | (2006.01) |
| ***A63B 21/00*** | (2006.01) |
| *A63B 71/06* | (2006.01) |

(52) U.S. Cl.
CPC ..... *A63B 22/0605* (2013.01); *A63B 21/4034* (2015.10); *A63B 21/4035* (2015.10); *A63B 69/16* (2013.01); *A63B 71/0622* (2013.01); *A63B 2022/0641* (2013.01); *A63B 2069/165* (2013.01); *A63B 2071/0638* (2013.01)

(58) Field of Classification Search
CPC ... A63B 22/0015–0023; A63B 22/0046–0048; A63B 22/06–0605; A63B 2022/0051–0053; A63B 2022/0092; A63B 2022/0635–0641; A63B 22/14–16; A63B 23/0476; A63B 21/4034; A63B 21/4035; A63B 69/16; A63B 71/0622; A63B 2069/165; A63B 2071/0638; A63F 13/90; A63F 13/803
See application file for complete search history.

(56) References Cited

U.S. PATENT DOCUMENTS

| | | | | |
|---|---|---|---|---|
| 4,817,939 | A | 4/1989 | Augspurger | |
| 6,126,577 | A * | 10/2000 | Chang | A63B 22/0605 D21/663 |
| 7,081,070 | B1 * | 7/2006 | Washington | A63B 22/0605 434/61 |
| 7,326,151 | B2 | 2/2008 | Peterson | |
| 7,438,672 | B1 * | 10/2008 | Rylander | A63B 22/0605 482/61 |
| 9,242,162 | B2 * | 1/2016 | Papadopoulos | A63B 69/16 |
| 9,327,163 | B2 | 5/2016 | Lin | |
| 10,039,954 | B1 * | 8/2018 | Tung | A63B 22/0605 |
| 10,434,394 | B2 | 10/2019 | Bass | |
| 10,702,739 | B1 * | 7/2020 | McCormack | A63B 21/0428 |
| 2005/0209064 | A1 * | 9/2005 | Peterson | A63B 69/16 482/61 |
| 2008/0020908 | A1 | 1/2008 | Ibarguren | |
| 2012/0071301 | A1 * | 3/2012 | Kaylor | A63B 21/00058 482/57 |
| 2016/0236036 | A1 | 8/2016 | Kalogiros | |

(Continued)

*Primary Examiner* — Garrett K Atkinson
*Assistant Examiner* — Kathleen M Fisk

(57) ABSTRACT

Provided herein is a dynamic device that can provide lateral rocking with fore-aft action to a stationary bicycle trainer. Also provided herein is a dynamic device, which can include a four-bar linkage mechanism that can provide a stationary trainer or stationary bicycle with an intuitive and natural-feel lateral rocking action and fore-aft action to simulate motions of a bicycle being ridden in a non-stationary environment.

20 Claims, 8 Drawing Sheets

(56) References Cited

U.S. PATENT DOCUMENTS

| | | | | |
|---|---|---|---|---|
| 2018/0369675 | A1 | 12/2018 | Papadopoulos | |
| 2019/0070476 | A1* | 3/2019 | Bass | A63B 21/005 |
| 2020/0061409 | A1* | 2/2020 | Lin | A63B 21/225 |
| 2020/0069997 | A1* | 3/2020 | Lin | A63B 22/0605 |
| 2021/0052937 | A1* | 2/2021 | Chen | A63B 21/0428 |

* cited by examiner

MECHANISM TO PROVIDE INTUITIVE MOTION FOR BICYCLE TRAINERS

CROSS-REFERENCE TO RELATED APPLICATIONS

The present application claims priority from provisional application 62/804,094 filed on Feb. 11, 2019 and from provisional application 62/832,909 filed on Apr. 12, 2019.

BACKGROUND

Stationary trainers or stationary bicycles are often used when outdoor cycling is impeded, such as with poor weather or traffic condition, or when a controlled environment for certain focused and uninterrupted exercises on a bicycle are desired.

Stationary trainers often operate by fixing an ordinary bicycle to a device, called a trainer. A trainer can include a resistance mechanism and a flywheel, the combination of which will hereafter be referred to as a resistance device.

In one variety of trainers, referred to as wheel-on trainers, a bicycle is held by the trainer at the rear wheel axle. The rear wheel tire is in contact with and drives the resistance device.

In another variety of trainer, referred to as direct-drive trainers, a bicycle's rear wheel is removed and the bicycle is mounted to the trainer at the rear wheel mounts. The resistance device of a direct-drive trainer is driven directly by the bicycle's chain rather than the tire.

Stationary bicycles are stationary cycling exercise machines that are intended for indoor use. A stationary bicycle can include a resistance device similar to a stationary trainer. A stationary bicycle can include a seat, handlebars, pedals and other components. A stationary bicycle is a complete exercise machine, whereas a stationary trainer is intended to have a bicycle mounted to it.

Alternatively, a stationary trainer or stationary bicycle can be provided with an adaptive resistance device. Adaptive stationary trainers are often called smart trainers. Adaptive stationary bicycles may be called smart bikes. Such smart trainers and smart bikes can adjust the environment of the ride, such as the resistance level of a resistance device in order to simulate hills, drafting, and other aspects of outdoor riding.

For example, a smart trainer or bike can be connected to applications that can provide a visual riding simulation experience. Such simulation applications can include a video of desired scenic route, which can be synchronized with a dynamically variable resistance to create a virtual reality type of experience. In one example, a cyclist using such a smart trainer or bike may want to stand up and sprint, climb, or perform other cycling ergonomics that are more dynamic than steady state riding on a stationary trainer. Typical stationary trainers mount the bicycle into a static position where the stationary trainer sits on the floor and does not allow any rocking motion, like those types of motions in outdoor cycling. Similarly, smart bikes are typically heavy rigid machines that do now allow dynamic motion.

In addition to the dynamic motions that an outdoor cyclist uses in sprinting or hill climbing, an outdoor cyclist on an outdoor bicycle makes lateral motions during the pedal stroke that induce a slight rocking of the bicycle. These lateral motions can reduce seat discomfort. The lateral motions can also provide leverage to aid with power output to the pedals. Rigid stationary trainers, such as wheel-on and direct-drive trainers, and stationary bicycles restrict this lateral motion as such motion may cause the stationary trainer to lose control of the bicycle.

On a bicycle fixed to a stationary trainer, or on a rigid stationary bicycle, power to the pedals is predominately from a cyclist's legs. A cyclist cannot induce or restrict lateral motion of the bicycle beyond that provided by the stationary trainer. In outdoor cycling, a cyclist can use core and upper body strength, to an extent, to balance and provide leverage for the pedal stroke. When using a stationary trainer these muscles are not required and as such, a cyclist can get an incomplete workout compared to outdoor riding. This reduction of muscle use can reduce the quality of a workout especially when compared to outdoor cycling. Many cyclists use stationary trainers or stationary bikes to prepare for outdoor riding. A rigid stationary trainer or stationary bike thus provides incomplete preparation by not including all muscle groups used in outdoor riding.

In outdoor cycling, a cyclist can keep a steady center of mass in the lateral direction using balance and counter-balance actions. In a standing position, such as during a sprint or hard climbing effort, a cyclist's mass is primarily supported at the pedals. When in a standing position, a cyclist can move the bicycle somewhat freely while keeping his or her mass relatively stable. The pedals rotate around the assembly of axle and bearings known as the bottom bracket of a bicycle. A cyclist can sway a bicycle laterally with a center of rotation roughly near the bottom bracket.

The ground plane can be defined as the surface in contact with the bottom of the tire. The top of the bicycle can be considered the portion of the bicycle near the handlebars. The tire track is the path that the tires make along the ground plane as the bicycle moves along the ground plane. In one example, when the top of the bicycle sways to the right, the bottom of the tires may move in the opposite direction, which in this case is to the left. In this way, the tire track will swerve from side to side as the cyclist sways the bicycle. In this example, the top of the bicycle and the bottom of the tires are moving in opposite directions laterally. The center of rotation is above the ground plane. The tire track can oscillate laterally around a generally straight line of forward motion. If the bottom bracket is the approximate center of the lateral rotation described in this example, the bicycle's bottom bracket will not be moving laterally to an extent noticeable by the cyclist. This allows the cyclist to keep their mass laterally stable with the bottom bracket while rocking the bicycle to increase power.

One method of providing lateral movement to a stationary trainer is to provide a pivot directly under a rocker plate that is supporting a bicycle and a stationary trainer. Energy rebounding components, such as foam blocks, partially inflated balls, or inner tubes are used below each side of rocker plate to provide centering forces to keep the bicycle in an upright neutral position to allow a cyclist to move the bicycle laterally.

However, this arrangement does not provide a natural-feel rocking motion. In such an arrangement, the bottom bracket can be approximately 300 mm above the lateral rotation axis. Because the cyclist must move their center of mass laterally along with a mechanical, pre-set rocking motion, it can be difficult to synchronize the motion of rocking the bicycle during standing efforts. Opposing forces applied to the pedals and handlebars may not have the same effect on the rocking motion because the pivot point has been moved from the bottom bracket to below the bottom surface of the tires. The resulting motion can be awkward and does not integrate into the motion of applying force to the pedals. The awkwardness is especially noticeable when a cyclist is standing out of the saddle.

Additionally, the cyclical power of the pedaling force typically causes the bicycle to surge or pulse fore and aft relative to the cyclist during riding. Because the pedals move in a circular motion, the force applied to the pedals can have a horizontal component as well as a vertical component. The horizontal component will tend to push the bicycle forward or rearward relative to the cyclist. Additionally, the circular motion of the pedals results in a fluctuating power output from the cyclist. The result of the horizontal forces and fluctuating power output is that in outdoor riding a bicycle can tend to move fore and aft relative to the cyclist. To mimic this relative motion on a stationary trainer or stationary bicycle fixed in place, a cyclist must surge their own mass fore and aft. This does not result in a realistic riding feel and can be less efficient for the cyclist. Alternatively, the cyclist can remain fixed in the fore-aft direction relative to the bicycle. This can result in unnatural pedaling dynamics and increased discomfort on the seat.

Embodiments of a dynamic trainer that can simulate a rocking motion with or without fore-aft motion similar to an on-road experience are provided herein. Embodiments disclosed herein are capable of accommodating and supplementing wheel-on trainers, direct-drive trainers, and stationary bicycles but can also be integrated with other trainers not discussed herein. Additionally, embodiments disclosed herein can be integrated into a structure of a wheel-on or direct-drive trainer, if desired. Other features and advantages of the invention will be apparent from the following description of the embodiments thereof, and from the claims.

SUMMARY

As used herein, the term "cyclist" or "rider" can indicate a user on a stationary trainer, a wheel-on trainer, direct-drive trainer, a stationary bicycle, etc.

In embodiments provided herein, a dynamic device, such as a dynamic trainer, and method of using a dynamic device to provide natural lateral and/or for-aft movement is described. By providing such a dynamic device, embodiments described herein can allow a cyclist to move dynamically in ways similar to riding on a moving bicycle, such as outdoors or in a velodrome, rather than on a stationary trainer. Embodiments described herein can provide a mechanism which can support a stationary trainer and can have a center of rotation near a bicycle's bottom bracket to provide a more accurate feel and function. Other embodiments can be produced with a center of rotation at any point above the surface which would contact the bottom of the bicycle tires.

In embodiments provided herein, a dynamic device can be provided along with a stationary device to allow a cyclist to be in a standing position, such as during a sprint or climbing effort, and the dynamic device can allow a cyclist to be able to rock a bicycle without requiring lateral motion of the cyclist's center of mass to pivot from the bottom of the bicycle. Pedal forces can also cause the bicycle to move fore and aft slightly during riding. Opposing up and down forces on the handlebars and pedals can also have a familiar effect on bicycle dynamics when provided with an example dynamic device compared to a moving bicycle. Example dynamic devices can also allow for a rocking action to be intuitive to a cyclist and easy to synchronize with pedaling motions.

In one embodiment, a dynamic device can be provided with a movable closed chain linkage, such as a four-bar mechanism or linkage, with a floating link that hangs from two or more side links.

An example embodiment is a four-bar linkage mechanism to provide a rocking and fore-aft motion for a stationary trainer. An example four-bar linkage mechanism can be defined by: a grounding base including two grounding pivots; a floating link with two pivots; a supporting member connected to the floating link which can support a bicycle and trainer; and two side links each connected to the grounding pivots in the base at one end and to the pivots on the floating link at the other end. In a nominal rest position the grounding pivots can be above the floating link pivots.

The base can include stanchions which provide support for grounding pivots elevated above the bottom surface of the base. The stanchions can be features integrated into the base or separate components attached to the base.

Additionally, two or more four-bar mechanisms can be used to provide stability perpendicular to a plane of a mechanism, wherein floating links of the two or more four-bar mechanisms can be connected and can move together. Multiple four-bar mechanisms can have common side links to improve synchronicity and stability between the four-bar mechanisms.

The structural components of the dynamic trainer including the support member, base, stanchions, floating links, and side links can be made of any stiff material that can provide support for a stationary trainer, as well as a cyclist thereon. For example, the frame can be made of wood, metal, plastic, or a composite such as carbon fiber. It has been found that a frame of wood provides durability and dampens noise from the trainer more than metal, for example. Various components of the dynamic trainer can be made of different materials, depending on the design considerations of the particular components.

In one, a supporting member can be allowed to swing laterally on a four-bar mechanism's floating link(s) of the four-bar mechanism(s), and a stationary trainer can be mounted onto the support member, which will be discussed further below.

The floating link can be attached to a plate or other member that supports the bicycle and stationary trainer. The floating link can be made in the shape of protrusions from the support member with squared, rounded, or other shaped areas to connect the dynamic device to the support member and thus the bicycle and stationary trainer. Each floating link can contain two features two provide a pivoting interface to the side link pivot interfaces.

Components of the four-bar mechanism are comprised of pivot features which can be used to connect the components pivotally. These features can be holes, studs, shafts, rods, or other attachment features that provide a means of pivotally connecting components. As used herein, the term "pivot" can indicate any such feature that can provide a means of pivotally connecting two or more components.

The side links can be provided with grounding pivots above the floating link pivot interfaces such that gravity can pull the floating link to a neutral center position relative to the dynamic device. The geometry of the four-bar mechanism can be designed such that the center line of the side links projects to an intersection near the bottom bracket. In one embodiment, a distance between grounding pivots can be less than the distance between floating link pivots. This geometry can provide a virtual center of rotation above the grounding pivots. By providing the side links in this location, a virtual center of motion of the dynamic device can be provided. Additionally, a variety of link lengths can be designed to have a different feel and range of motion.

Additionally, in one embodiment, a four-bar linkage can be symmetrical around a vertical plane perpendicular to a plane of action. Specifically, side links can be of equal length and grounding pivots can be at an equal vertical elevation to the side links.

By providing one or more of the geometries described herein, the dynamic device can be naturally stable at a center position without requiring opposing spring forces to hold it in the lateral neutral center position.

In embodiments herein, two or more four-bar mechanisms can be used to provide dynamic movement, as well as, stability in a fore-aft direction in addition to a lateral direction. The floating links of these four-bar mechanisms can be connected such that the floating links move together as a single unit. In another embodiment, grounding links can be provided and can be fixed together, either via structure in the device, or by resting on a common surface, where the grounding links would be in addition to the floating links, which will further discussed below with the Figures.

Additionally, in embodiments herein, side links on either side of the four-bar mechanisms can be connected as extended side links. In this way, the extended side links can be common to two or more four-bar mechanisms.

Additionally, a dynamic trainer according to the embodiments described herein can be integrated into a stationary exercise bicycle. In such embodiments, the support member can be integrated into the structure of the stationary bicycle.

In another group of embodiments which will be explained further below, linear bearings can provide a means of fore-aft motion on a plurality of linear shafts or rods at the side link assembly pivots. The linear bearings can travel fore and aft on the linear rods as well as rotate on the linear rods.

In the embodiments with linear bearings described herein, mechanical energy absorbing elements can be included in the dynamic trainer to provide a means of returning the dynamic trainer away from the limits of fore-aft travel. These energy absorbing elements can be metal springs, elastic cords, or other components that are capable of absorbing and returning kinetic energy. The energy absorbing elements can be between any component of the dynamic trainer that is capable of moving in the fore-aft direction and a component that is stationary in the fore-aft direction.

In one embodiment, linear bearings can be included in the lower side link pivots of the side link assemblies. One or more linear rods can be connected at the floating link pivots. The upper side link pivots in this embodiment can be pivotally connected to the grounding pivots of the base or stanchions. The linear rods can move in the fore-aft direction through the linear bearings in the side link assemblies. In this way, the linear rods, floating links, and support member can move together in the fore-aft direction.

In another embodiment, linear bearings can be included in the upper side link pivots of the side link assemblies. One or more linear rods can be connected at the grounding pivots in the base or stanchions. The lower side link pivots in this embodiment can be pivotally connected to the floating link pivots. The linear bearings in the side link assemblies can move along the linear rods in the fore-aft direction. In this way, the side link assemblies, floating links, and support member can move together in the fore-aft direction.

In another embodiment, linear rods can be fixed to side links at the upper side link pivots so that the side link assembly includes one or more linear rods. The lower side link pivots in this embodiment can be pivotally connected to the floating link pivots. Linear bearings can be included in the grounding pivots in the base or stanchion. The linear rods within the side link assemblies can move in the fore-aft direction through the linear bearings. In this way, the side links, linear rods, floating links, and support member can move together in the fore-aft direction.

In another embodiment, linear rods can be fixed to side links at the lower side link pivots so that the side link assembly includes one or more linear rods. The upper side link pivots in this embodiment can be pivotally connected to the grounding pivots. Linear bearings can be included in the floating link pivots. The linear bearings can move in the fore-aft direction along the linear rods of the side link assemblies. In this way, the floating links, and support member can move together in the fore-aft direction.

BRIEF DESCRIPTION OF THE DRAWINGS

The accompanying drawings, which are incorporated and constitute a part of this specification, illustrate example embodiments. In the drawings.

DETAILED DESCRIPTION

Figure 1:
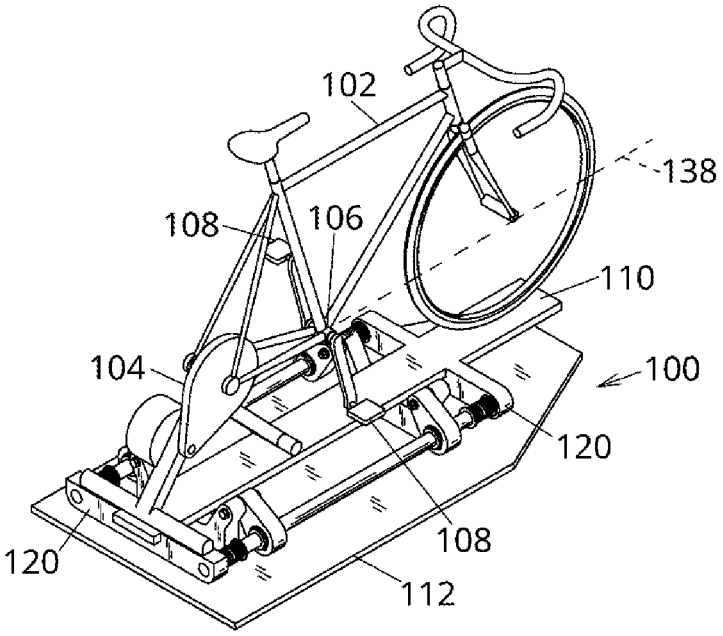
FIG. 1 is an illustration of an embodiment of a bicycle and a dynamic trainer.

In one example, as illustrated in FIG. 1, an embodiment of dynamic trainer 100 is shown with a bicycle 102 and a stationary trainer 104 ready for use in conjunction with dynamic trainer 100. A typical bicycle 102 will include pedals 108 which rotate around the axle and bearings known as the bottom bracket 106. Dynamic trainer 100 can be directed to focus on bottom bracket 106 as a neutral position instant center 138. It is noted that positions other than bottom bracket 106 as the neutral position instant center 138 may be used. For example, the neutral position instant center 138 may be adjusted as needed for different stationary trainers 104 or bicycles 102.

A grounding base 112 can be configured and constructed to provide a stable interface to a substantially flat surface such as a floor.

A support member 110 can be sized as needed to fit a variety of different shaped or sized stationary trainers 104. Support member 110 can provide structural support for bicycle 102 and stationary trainer 104 to attach to dynamic trainer 100. Support member 110 can be the component of dynamic trainer 100 that connects floating links 120 to stationary trainer 104 and bicycle 102. Floating links 120 can be the members of the four-bar mechanism that determine the position and angle of stationary trainer 104 and bicycle 102 as the four-bar mechanism moves through its range of motion. Various mechanical means of attachment and methods can be used to fix stationary trainer 104 to dynamic trainer 100 via support member 110 including U-bolts, zip-ties, straps, etc. (not shown) as determined by one skilled in the art.

In one example embodiment, a cyclist can attach their bicycle 102 to support member 110 using stationary trainer 104. Next the cyclist could start a visual simulation program with a data connection to stationary trainer 104, and the cyclist can get on the bicycle, and start pedaling. When an opportunity for a hill occurs in the visual simulation, then stationary trainer 104 can be engaged by the visual simulation program to allow for increased effort by the cyclist. The cyclist can then utilize the dynamic motion provided by dynamic trainer 100 to experience a more realistic hill climbing effort.

Figure 2:
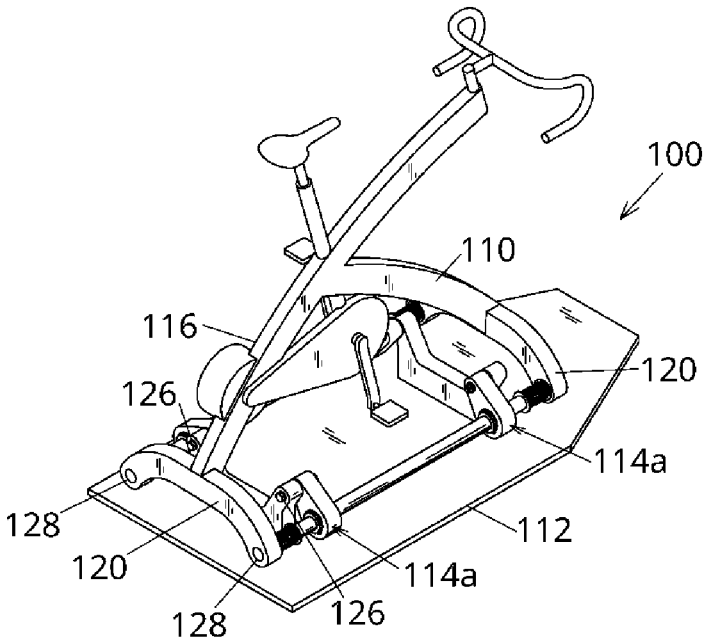
FIG. 2 is an illustration of an embodiment of a stationary bicycle integrated with a dynamic trainer.

In an example illustrated in FIG. 2, an embodiment of a dynamic trainer 100 is shown integrated with a stationary bicycle 116. Support member 110 is integrated into the structure of stationary bicycle 116 so that stationary bicycle 116 can move according to the actions of dynamic trainer 100. Similar to the embodiment of FIG. 1, base 112 can be configured and constructed to provide a stable interface to a substantially flat surface. Various configuration embodiments of dynamic trainer 100 can be integrated into stationary bicycle 116.

The example four-bar mechanism shown in FIG. 2 is comprised of base 112, floating links 120, and side link assemblies 114*a*. The four-bar plane of motion is substantially perpendicular to the axis of the four-bar mechanism pivots defined by grounding pivots 126 and floating link pivots 128.

An example dynamic trainer 100 can include support member 110, floating links 120, side link assemblies 114*a*, and base 112. Support member 110 can be sized and configured as needed to fit a variety of different shaped or sized stationary bicycles 116. Support member 110 provides structural support for the remainder of stationary bicycle 116.

Figure 3:
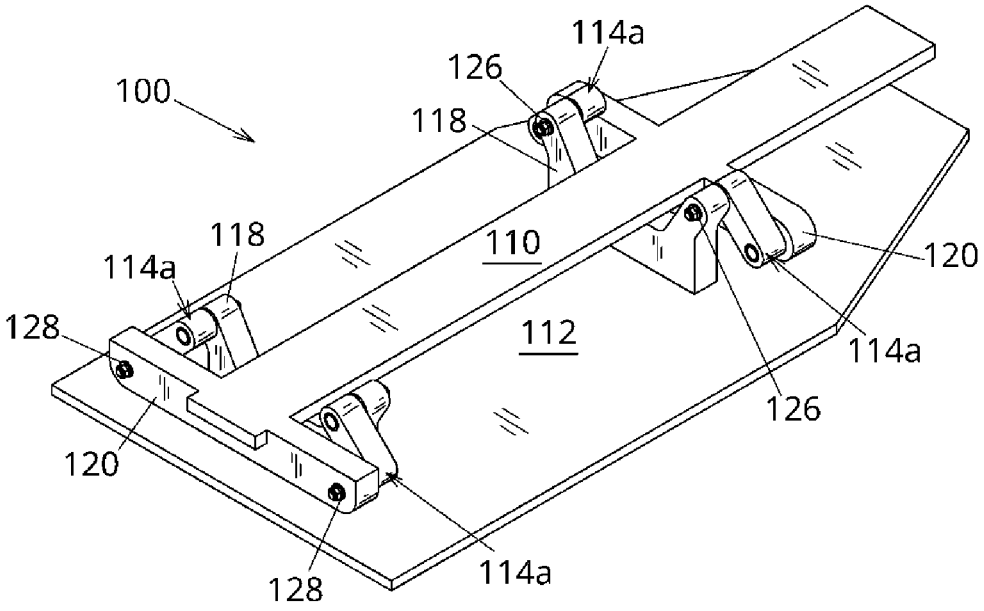
FIG. 3 is an illustration of an example dynamic trainer.

In the example dynamic trainer 100 shown in FIG. 3, floating links 120 can be part of support member 110 and can allow for connection to side link assemblies 114*a* to support member 110. Floating links 120 can be provided as moment arms for side link assemblies 114*a* to provide motion to support member 110.

Base 112 can be used for providing stability to dynamic trainer 100 by providing support against the ground as a base for movement of floating links 120 and/or support member 110. Stanchions 118 can be connected to or integrated into base 112. Stanchions 118 can provide stationary points, or grounding pivots 126, that side link assemblies 114*a* can rotate around.

Base 112 can include two or more stanchions 118 with grounding pivots 126 to provide a connection between stanchions 118 and side link assemblies 114*a*. Stanchions 118 can provide support between support member 110 and base 112 via side link assemblies 114*a*. Stanchions can also have different sizes, shapes, and orientations, and can provide support in other directions as desired. Floating link pivots 128 in floating links 120 can provide a means for connecting support member 110 to side link assemblies 114*a*.

Side link assemblies 114*a* can be used for allowing movement of support member 110 via floating links 120. Side link assemblies 114*a* can define the range of motion that floating links 120 move through by defining a circular path that certain points, or floating link pivots 128, on the floating link 120 move through.

For example, support member 110 can be fixed to two floating links 120, wherein support member 110 can force floating links 120 to move together. Each of side link assemblies 114*a* can be connected to floating link 120 at floating link pivots 128, and to support base 112 at grounding pivots 126. Side link assemblies 114*a*, along with floating link 120 and base 112 can also be oriented in other directions to provide range of motion in these directions as well, if desired.

Figure 4:
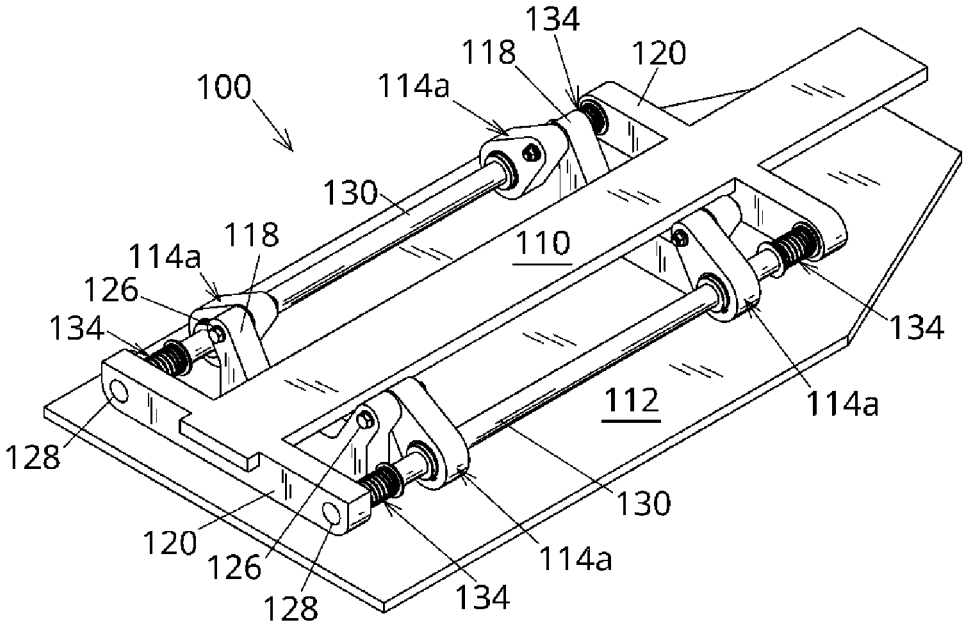
FIG. 4 is an illustration of an example dynamic trainer.

In FIG. 4, an example dynamic trainer 100 is illustrated with support member 110 to be attached to base 112 via floating links 120, side link assemblies 114*a*, and stanchions 118. In the embodiment shown in FIG. 4, linear rods 130 are connected at floating link pivots 128. Support member 110 is then free to move in the fore-aft direction via side link assemblies 114*a* moving along linear rods 130.

For example, support member 110 can be fixed to two floating links 120, wherein support member 110 can force floating links 120 to move together. Each of side link assemblies 114*a* can be connected to a floating link 120 at one end, and to base 112 at the other end.

Additionally, these rotational connections can allow freedom of motion along their pivotal axis as well as the rotation around the said pivotal axis. In the example shown, side link assemblies 114*a* are able to move fore and aft along as well as rotate around linear rods 130. Spring assemblies 134 can be used to return support member 110 toward a neutral fore-aft position during dynamic fore-aft motion. Linear rods 130 can be retained as needed. Side link assemblies 114*a*, along with floating link 120 and base 112 can also be oriented in other directions to provide range of motion in these directions as well, if desired.

Base 112 can include two or more stanchions 118 and grounding pivots 126 to provide a connection between stanchions 118 and side link assemblies 114*a*. Stanchions 118 can provide diagonal support between support member 110 and base 112. Stanchions 118 can also have different sizes, shapes, and orientations, and can provide support in other directions as desired.

Support member 110 can also have floating link pivots 128 in floating links 120 to provide a means for connecting support member 110 to side link assemblies 114*a*.

Figure 5:
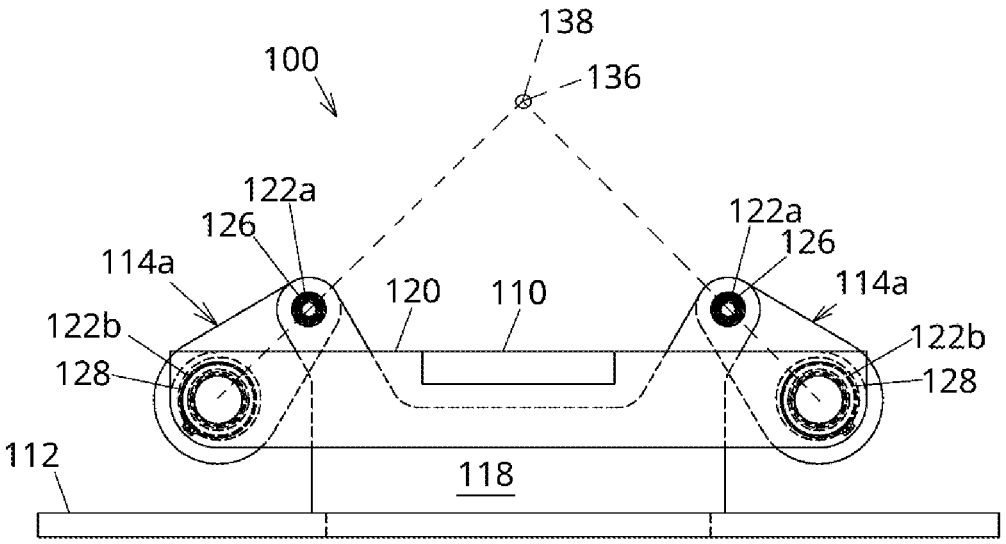
FIG. 5 is a mechanism diagram of a rear view of an example dynamic trainer with the dynamic trainer at the center position.

FIG. 5 shows a rear view of an embodiment dynamic trainer 100 in a centered and neutral position for use as a starting point (when attached to stationary trainer 104 and bicycle 102 (as shown in FIG. 1, but not shown in FIG. 5)). In this position, neutral position instant center 138 is identified by the intersection of the projections of the centerline of the alignment of side link assemblies 114*a*. The disposition of side link assemblies 114*a* can be substantially symmetrically connected to support member 110 and base 112.

Each stanchion 118 can contain two or more grounding pivots 126. In the embodiments shown in FIGS. 5 and 6, two grounding pivots 126 can be provided substantially equidistant from the ground plane defined by the bottom of base 112, although other geometries can be used. Side link pivots 122*a* can be connected to grounding pivots 126 so that side link assemblies 114*a* rotate around the axis of grounding pivots 126.

In the embodiment shown, the top surface of support member 110 is below grounding pivots 126. In other embodiments not shown, the top surface of support member 110 can be above grounding pivots 126.

Each floating link 120 can include two floating link pivots 128. Side link pivots 122*b* can be connected to floating link pivots 128 so that floating links 120 and side link assemblies 114*a* rotate relative to each other around the axis of floating link pivot 128.

The pull of gravity in the negative z-direction applied to support member 110 in the center plane of the mechanism can be utilized to position support member 110 into neutral position instant center 138 as illustrated in FIGS. 1 and 5. This attribute can make dynamic trainer 100 inherently stable during non-use and during seated riding with small lateral forces applied.

With the four-bar mechanism in the neutral position as shown in FIG. 5, the projected intersection of the centerlines of side link assemblies 114*a* is the neutral position instant center 138. With the distance between floating link pivots 128 larger than the distance between grounding pivots 126, the neutral position instant center 138 will be located above grounding pivots 126. Additionally, the floating links 120 and support member 110 can be configured so that the neutral position instant center 138 is above the top surface of support member 110.

The four-bar mechanism shown in FIG. 5 includes a point known as the coupler point 136. Coupler point 136 is a position fixed relative to floating link 120 and floating link pivots 128. In the embodiment shown, coupler point 136 is defined as being coincident with the neutral position instant center 138. In one embodiment, coupler point can 136 also be substantially coincident with the center of bottom bracket 106 (shown in FIG. 1, but not shown in FIG. 5).

Figure 6:
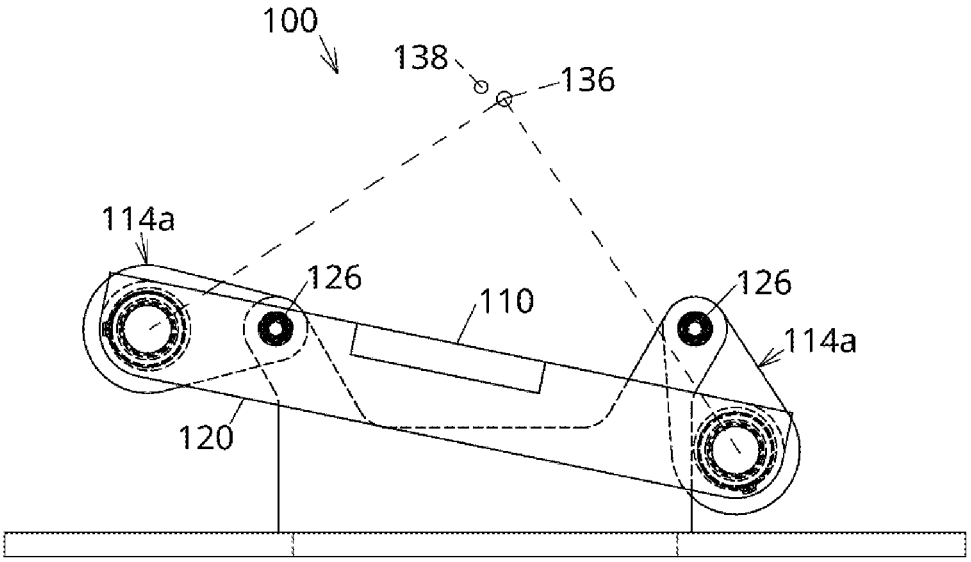
FIG. 6 is a mechanism diagram of a rear view of an example dynamic trainer with mechanism rotated from the center position.

As illustrated in FIG. 6, as side link assemblies 114*a* rotate around grounding pivots 126, floating links 120 and support member 110 tilts and coupler point 136 moves slightly. In the embodiment shown, side link assemblies 114*a* of dynamic trainer 100 can be equal in length, width, and height to provide symmetrical behavior. A shift in a cyclist's center of mass away from the mechanism center plane, or a torque applied by the cyclist around an axis perpendicular to the mechanism plane of action, can cause coupler point 136 to rotate away from neutral position instant center 138. The motion of coupler point 136 can be very small, such as between 1-25 mm.

Figure 7:
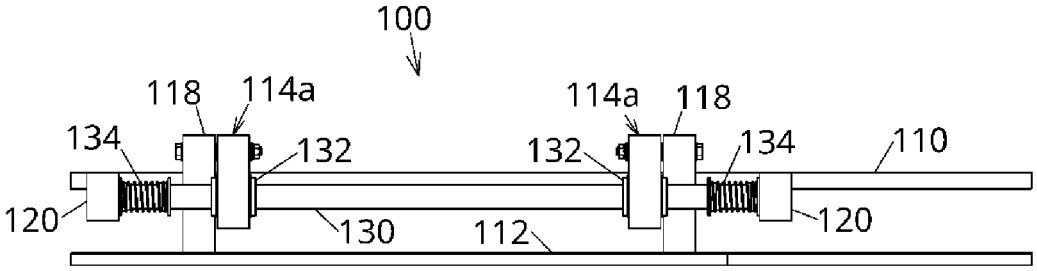
FIG. 7 is a side view of an example dynamic trainer.

FIG. 7 is a side view illustrating the components of dynamic trainer 100 that enable support member 110 to move fore and aft with rider pedaling force input. Side link assemblies 114*a* can include linear bearings 132 to allow side link assemblies 114*a* to move along linear rods 130. Kinetic energy absorbing components can be included in dynamic trainer 100 to return support member 110, floating links 120, and side link assemblies 114*a* from the ends of the fore-aft travel range and toward the center of the fore-aft travel range of dynamic trainer 100. In the embodiment shown in FIG. 7, the energy absorbing components are spring assemblies 134 at the ends of linear rod 130. Base 112 and stanchions 118, through side link assemblies 114*a*, can provide grounding for the force applied by spring assemblies 134 to react against.

Figure 8:
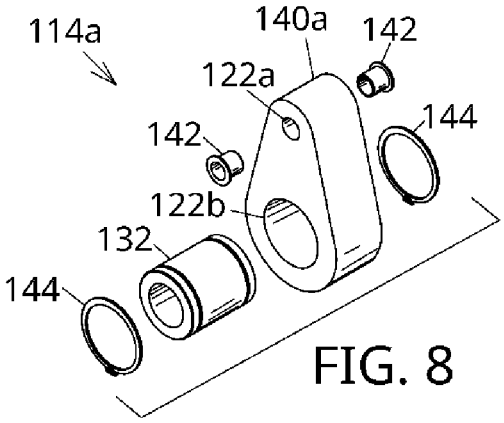
FIG. 8 is a detailed view of an example side link assembly of a dynamic trainer.

FIG. 8 is a detailed view of an example side link assembly 114*a*. In this embodiment, rotation of side link assembly 114*a* around pivotal connections made at side link pivot 122*a* can be enabled by two pivot bearings 142. Pivot bearings 142 can be pressed into the side links 140*a*, machined into side links 140*a*, or provided by a different connector as needed.

Additionally, in this embodiment, rotation of side link assembly 114*a* at pivotal connections between at side link pivot 122*b* can be enabled by linear bearing 132. Linear bearing 132 can also allow motion along the axis of linear bearing 132. Linear bearings 132 can be ball bearings, self-lubricating polymer bearings, or other bearings that allow axial and rotational motion. Linear bearings 132 can be pressed into the side links 140*a*, machined into side links 140*a*, or provided by a different connector as needed. Retainer ring 144 can be used to keep linear bearings 132 from sliding into side link pivot 122*b*. Other embodiments can have various types of connectors, bearings, or bearing arrangements and may include washers and/or spacers as needed.

Figure 9:
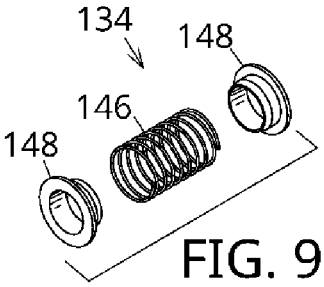
FIG. 9 is a detailed view of an example spring assembly of a dynamic trainer.

FIG. 9 is a detailed view of an example spring assembly 134. Spring bushings 148 can be designed to have a press-fit interface into the inner diameter of spring 146 so that spring bushings 148 can move with the ends of spring 146.

FIG. 7, FIG. 8, and FIG. 9 together illustrate an embodiment for allowing and managing fore-aft motion in dynamic trainer 100. During dynamic fore-aft motion, floating link 120, with support member 110 attached, can be returned away from its fore-aft range of motion and toward its center neutral fore-aft position by the reaction force provided by springs 146. Spring assemblies 134 can be placed at each end of each linear rod 130 to balance out these reaction forces. Spring bushings 148 can be used to provide a smooth interface to linear rod 130, linear bearing 132, and floating link 120. Retainer ring 144 can prevent the reaction force of spring 146 from pushing linear bearing 132 out of side link 140*a*.

Figure 10:
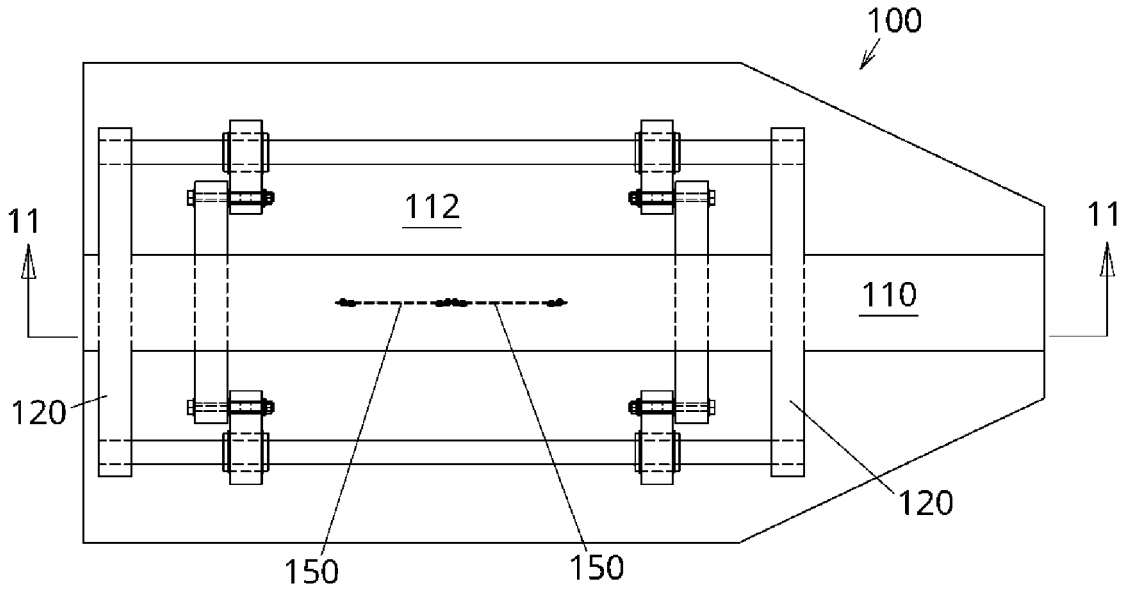
FIG. 10 is a top view of an example dynamic trainer.

FIG. 10 is a top view of an embodiment of dynamic trainer 100 with another method of returning support member 110 with floating links 120 away from the ends of the fore-aft range of motion. In the embodiment shown, elastic cords 150 are used to move the dynamic trainer 100 away from the limits of fore-aft motion.

Figure 11:
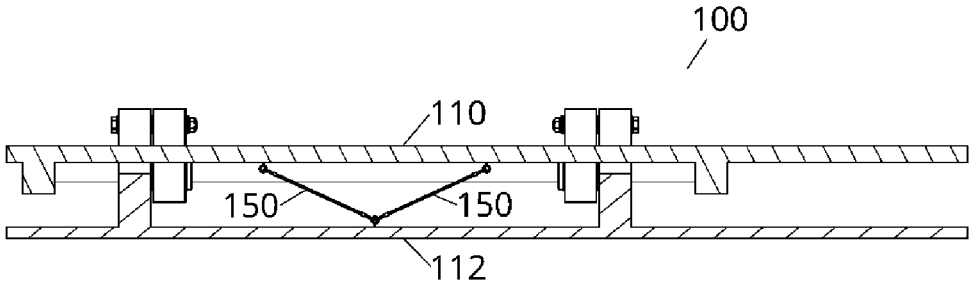
FIG. 11 is a detailed sectional view of an example dynamic trainer.

FIG. 11 is a section view that shows the detail of elastic cords 150 from the embodiment of FIG. 10. Elastic cords 150 are shown which can be connected between base 112 and support member 110. Elastic cords 150 can also be metal coil extension springs. Such elastic cords 150 will pull support member 110 toward the center of the range of fore-aft motion as they reach an equilibrium between the plurality of elastic cords 150. In this way, many embodiments can be used to provide an interface between the stationary portions of dynamic trainer 100 and the portions of dynamic trainer moving in the fore-aft direction in order to return the moving portions of dynamic trainer 100 toward the center of the fore-aft range of motion after fore-aft force inputs from the rider.

Figure 12:
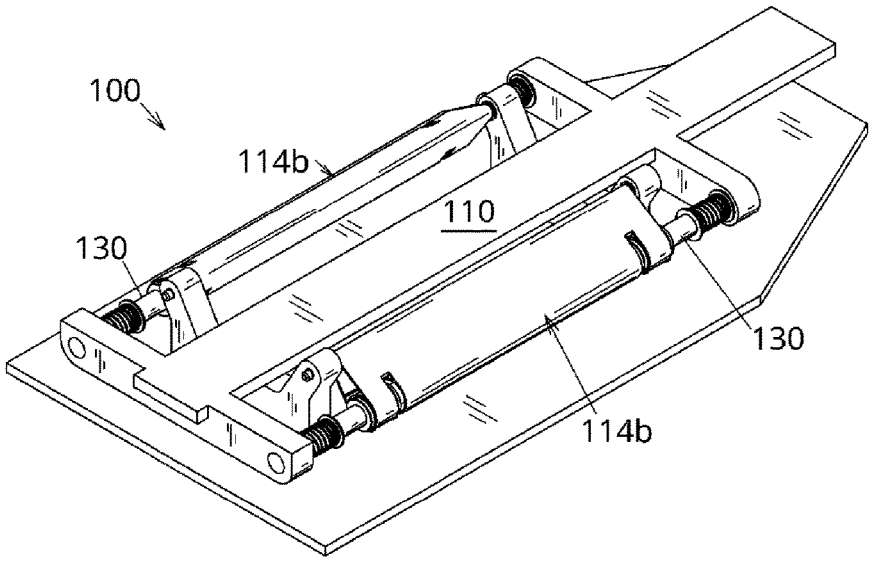
FIG. 12 is an illustration of an example dynamic trainer.

FIG. 12 illustrates another example embodiment of dynamic trainer 100. In this embodiment, the two side link assemblies 114*a* (shown in FIG. 4 but not in FIG. 12) on either side of dynamic trainer 100 such as in FIG. 4 can be merged into extended side link assemblies 114*b*. Alternatively, an extended side link assembly 114*b* could be applied to the embodiments of FIG. 3, FIG. 14, or other embodiments. Side link assemblies 114*b* can pivot on and move along linear rods 130 so that support member 110 can move laterally and fore and aft as in other embodiments of dynamic trainer 100.

Figure 13:
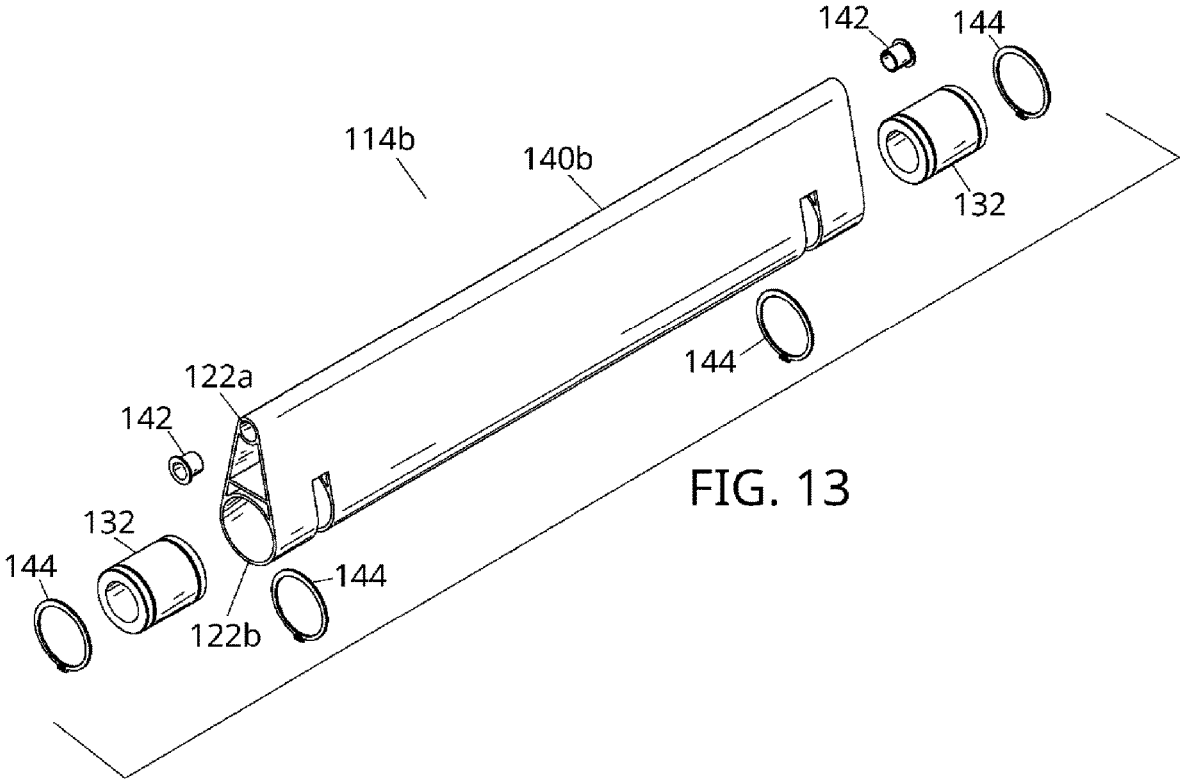
FIG. 13 is a detailed view of an example side link assembly of a dynamic trainer.

FIG. 13 is a detailed view of an example side link assembly 114*b*. Extended side link 140*b* can be made to provide side link pivots 122*a* and 122*b* at each end or through the full length of side link 140*b*. Side link 140*b* can be made of extruded aluminum, extruded plastic, carbon fiber, or other suitable materials. Linear bearings 132 can be retained in either end of side link pivot 122*b* with retainer rings 144. In alternate embodiments, a full length bearing sleeve can be used instead of separate linear bearings 132. Pivot bearings 142 can be pressed into either end of side link pivot 122*a*. Note that in other configuration embodiments, the extended side link assembly may be placed inverted compared to the placement in FIG. 12.

Figure 14:
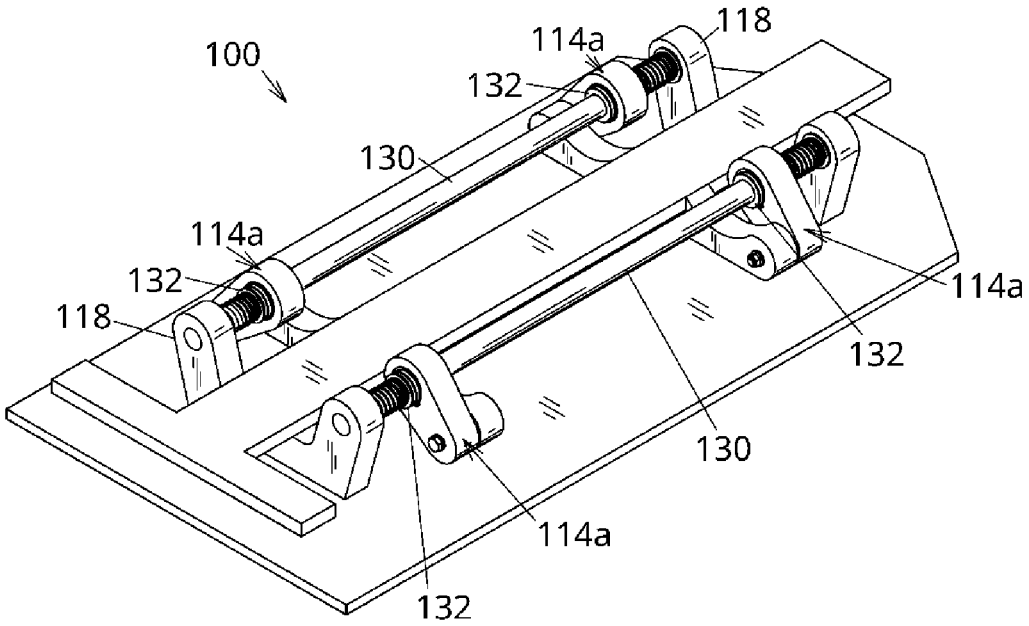
FIG. 14 is an illustration of an example dynamic trainer.

FIG. 14 illustrates an example configuration embodiment of dynamic trainer 100. In the embodiment shown, the linear rods 130 are fixed to stanchions 118. Side link assemblies 114*a* such as detailed in FIG. 8 can be assembled into dynamic trainer 100 so that linear rods 130 pass through linear bearings 132 in side link assemblies 114*a*.

Figure 15:
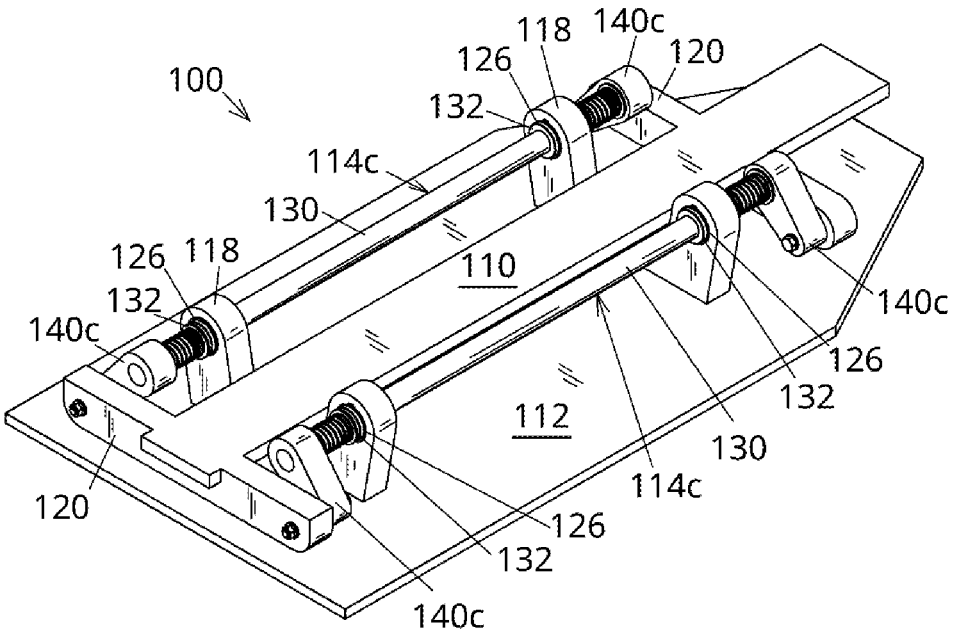
FIG. 15 is an illustration of an example dynamic trainer.
Figure 16:
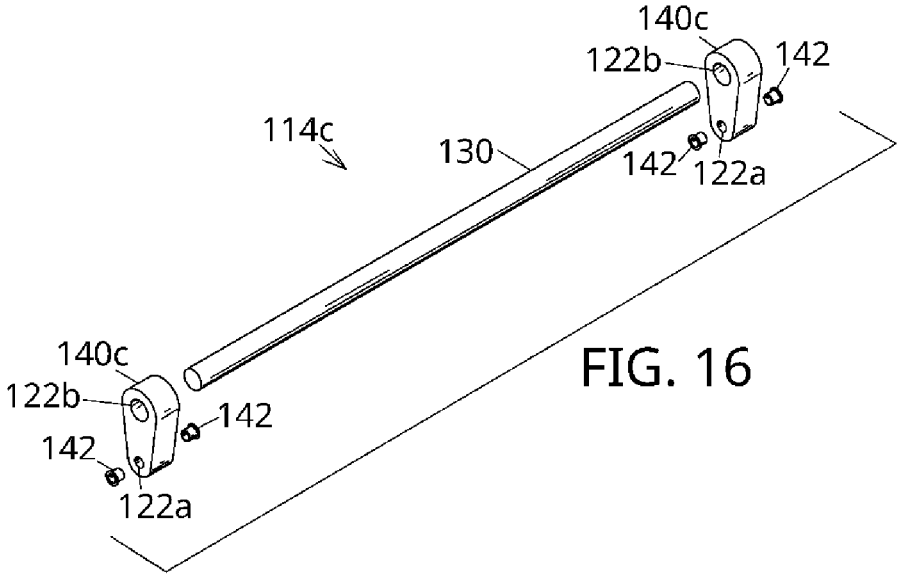
FIG. 16 is a detailed view of an example side link assembly of a dynamic trainer.

FIG. 15 and FIG. 16 illustrate an example configuration embodiment of dynamic trainer 100. In the embodiment shown in FIG. 15, linear rods 130 can be fixed to side links 140*c* and linear bearings 132 can be fixed into grounding pivots 126. In this embodiment, side links 140*c* along with linear rod 130 are joined together as components of side link assembly 114*c*. Linear bearings 132 are fixed into the grounding pivots 126 of stanchions 118. Support member 110 with floating links 120 and side link assemblies 114*c* move together through linear bearings 132 in the fore-aft direction.

FIG. 16 details the composition of side link assemblies 114*c* for this embodiment. A plurality of pivot bearings 142 can be pressed into the side link pivots 122*a* of side links 140*c*. Other types of bearings and assembly methods can be used to allow rotation of side link assemblies 114*c* at side link pivots 122*a*. As indicated in FIG. 15, linear rod 130 can be fixed to side link pivots 122*b*.

Figure 17:
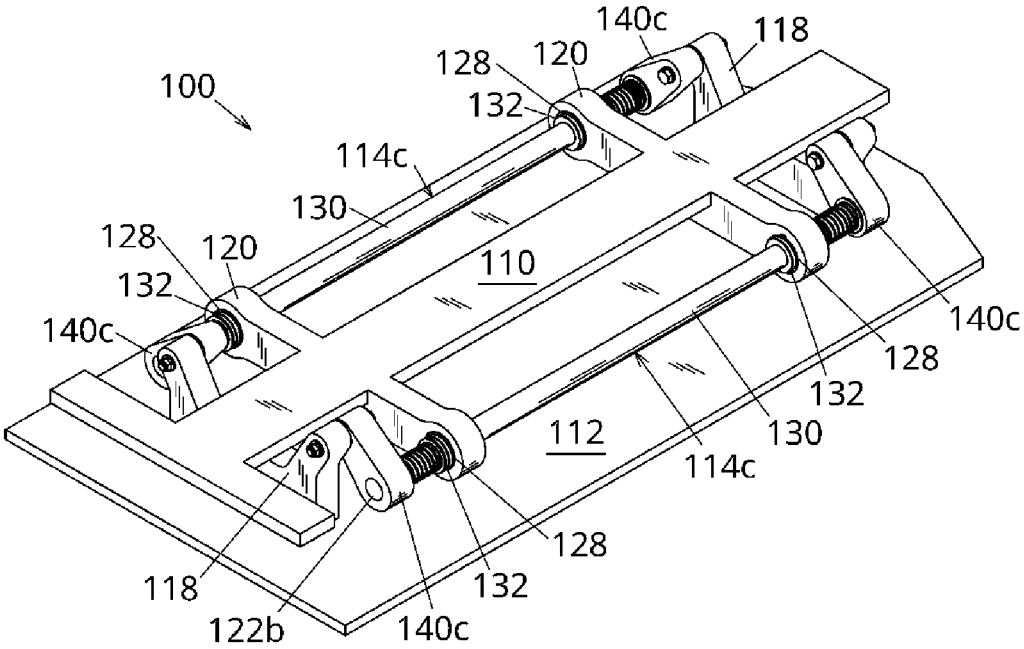
FIG. 17 is an illustration of an example dynamic trainer.

FIG. 17 illustrates an example configuration embodiment of dynamic trainer 100. Side link assemblies 114*c* shown in FIG. 16 can be utilized in an inverted way from FIG. 15. In the embodiment shown, linear rods 130 can be fixed to side links 140*c* in side link pivots 122*b* and linear bearings 132 can be fixed into floating link pivots 128. In this embodiment, side links 140*c* along with linear rod 130 are together as components of side link assembly 114*c*. Side links 140*c* can remain stationary in the fore-aft direction with stanchions 118 and base 112. Support member 110 with floating links 120 move along linear rods 130 in the fore-aft direction.

While the invention has been described in detail with reference to preferred embodiments thereof, it will be apparent to those skilled in the art that variations and modifications can be made, and equivalents employed without departing from the scope of the appended claims.

The embodiments discussed herein provide a means enabling cyclist on a stationary trainer or stationary bicycle to move the bicycle dynamically in ways similar to riding a bicycle outdoors.

The four-bar mechanism of the embodiments can provide a means for lateral rotation of the bicycle. The four-bar mechanism can provide a rotation center near the bottom bracket so that the cyclist will not be required to move his or her mass laterally significantly. The four-bar mechanism with thereby enable the cyclist experience a more realistic lateral rotation motion than prior-art rocker plates provide. Additionally, the four-bar mechanism provides an inherent lateral stability that prior-art rocker plates do not.

For some embodiments, the linear bearings and linear rods integrated into the four-bar mechanism provide a fore-aft movement in reaction to variations in the pedal forces. This action further enable the cyclist to experience a realistic riding motion.

The invention claimed is:

1. A dynamic device to provide a rocking motion for a stationary trainer used in bicycling, comprising:
- a base;
- a support member to connect to the stationary trainer;
- one or more floating links connected to or integrated with the support member;
- a plurality of side link assemblies connecting the floating links and the base;
- two sets of at least one linear rod; and
- two sets of at least one linear bearing;
- wherein the linear bearings are disposed to move relative to the linear rods in rotational and axial directions, and
- whereby said support member is configured to slidably move substantially perpendicular to a plane of action of said dynamic device.

2. The dynamic device of claim 1, wherein the support member is integrated into a stationary bicycle comprising of:
- a resistance device to provide urging resistance to pedals;
- a bottom bracket providing rotation of the pedals;
- a seat; and
- handlebars.

3. The dynamic device of claim 1,
- wherein the linear rods are connected to said floating links, and
- wherein the linear bearings are connected to said side link assemblies.

4. The dynamic device of claim 1,
- wherein the linear rods are connected to said base, and
- wherein the linear bearings are connected to said side link assemblies.

5. The dynamic device of claim 1,
- wherein the linear rods are connected to said side link assemblies, and
- wherein the linear bearings are connected to said base.

6. The dynamic device of claim 1,
- wherein the linear rods are connected to said side link assemblies, and
- wherein the linear bearings are connected to said floating links.

7. A dynamic device including a four-bar mechanism to provide motion for a stationary bicycle trainer, comprising:
- a base including two sets of one or more grounding pivots;
- one or more floating links collectively providing two sets of one or more floating link pivots;
- a support member connected to or integrated with the floating links which is configured to support a cyclist and a stationary trainer;
- two or more of side links each with two or more side link pivots;
- two sets of at least one linear rod; and
- two sets of at least one linear bearing;
- wherein each of the side links is connected to at least one of the grounding pivots and to at least one of the floating link pivots,
- wherein the grounding pivots within each of said sets are substantially coaxially aligned,
- wherein the floating link pivots within each of said sets are substantially coaxially aligned,
- wherein the floating link pivots are connected to the grounding pivots through the side links, wherein a distance between the two sets of grounding pivots is less than a distance between the two sets of floating link pivots, wherein the linear bearings are disposed to move relative to the linear rods in rotational and axial directions, and whereby said support member is configured to slidably move substantially perpendicular to a plane of action of said four-bar mechanism.

8. The dynamic device of claim 7, wherein the four-bar mechanism is substantially symmetrical around a vertical plane perpendicular to the plane of action, wherein said side links are of substantially equal length, and wherein the two sets of said grounding pivots are approximately aligned in at least one direction.

9. The dynamic device of claim 7, wherein the support member is integrated into a stationary bicycle comprising of:

a resistance device to provide urging resistance to pedals;

a bottom bracket providing rotation of the pedals;

a seat; and handlebars.

10. The dynamic device of claim 7, wherein the linear rods are connected at said floating link pivots, and wherein the linear bearings are connected at said side link pivots.

11. The dynamic device of claim 7, wherein the linear rods are connected at said grounding pivots, and wherein the linear bearings are connected at said side link pivots.

12. The dynamic device of claim 7, wherein the linear rods are connected at said side link pivots, and wherein the linear bearings are connected at said grounding pivots.

13. The dynamic device of claim 7, wherein the linear rods are connected at said side link pivots, and wherein the linear bearings are connected at said floating link pivots.

14. A dynamic device including a four-bar mechanism to provide motion for a stationary bicycle trainer, comprising:

a base including two sets of one or more grounding pivots;

one or more floating links collectively providing two sets of one or more floating link pivots;

a support member connected to or integrated with the floating links which is configured to support a cyclist and a stationary trainer;

two or more of side links each with two or more side link pivots;

two sets of at least one linear rod; and two sets of at least one linear bearing, wherein each of the side links is connected to at least one of the grounding pivots and to at least one of the floating link pivots, wherein the grounding pivots within each of said sets are substantially coaxially aligned, wherein the floating link pivots within each of said sets are substantially coaxially aligned, wherein the floating link pivots are connected to the grounding pivots through the side links, wherein a distance between the two sets of grounding pivots is less than a distance between the two sets of floating link pivots, wherein the linear bearings are disposed to move relative to the linear rods in rotational and axial directions, wherein the linear bearings and linear rods are substantially coaxially aligned with said side link pivots, and whereby said support member is configured to slidably move substantially perpendicular to a plane of action of said four-bar mechanism and rock substantially parallel to the plane of action of said four-bar mechanism.

15. The dynamic device of claim 14, wherein the four-bar mechanism is substantially symmetrical around a vertical plane perpendicular to the plane of action, wherein said side links are of substantially equal length, and wherein the two sets of said grounding pivots are approximately aligned in at least one direction.

16. The dynamic device of claim 14, wherein the support member is integrated into a stationary bicycle comprising of:

a resistance device to provide urging resistance to pedals;

a bottom bracket providing rotation of the pedals;

a seat; and handlebars.

17. The dynamic device of claim 14, wherein the linear rods are connected at said floating link pivots, and wherein the linear bearings are connected at said side link pivots.

18. The dynamic device of claim 14, wherein the linear rods are connected at said grounding pivots, and wherein the linear bearings are connected at said side link pivots.

19. The dynamic device of claim 14, wherein the linear rods are connected at said side link pivots, and wherein the linear bearings are connected at said grounding pivots.

20. The dynamic device of claim 14, wherein the linear rods are connected at said side link pivots, and wherein the linear bearings are connected at said floating link pivots.

* * * * *